United States Patent [19]

Osborne

[11] 4,319,710

[45] Mar. 16, 1982

[54] REINFORCED END SEALED CONTAINER

[75] Inventor: Edward L. Osborne, Kansas City, Kans.

[73] Assignee: Westvaco Corporation, New York, N.Y.

[21] Appl. No.: 145,866

[22] Filed: May 1, 1980

[51] Int. Cl.[3] ..... B65D 5/26; B65D 5/24

[52] U.S. Cl. ..... 229/33; 229/45 R

[58] Field of Search ..... 229/44, 45, 33, 37 R, 229/38, 23 R

[56] References Cited

U.S. PATENT DOCUMENTS

| | | | |
|---|---|---|---|
| 3,197,110 | 7/1965 | Neuman et al. | 229/38 |
| 3,586,233 | 6/1971 | McCulloch | 229/44 X |
| 3,713,579 | 1/1973 | Chaffers | 229/44 |
| 3,825,170 | 7/1974 | Aust et al. | 229/38 X |
| 3,843,040 | 10/1974 | Locke | 229/38 |
| 3,905,541 | 9/1975 | Paxton | 229/23 R |
| 3,921,896 | 11/1975 | Ishimura | 229/45 X |
| 4,129,247 | 12/1978 | McCall | 229/36 |
| 4,175,691 | 11/1979 | Cornell et al. | 229/23 R X |
| 4,236,740 | 12/1980 | Sorenson et al. | 229/36 |

*Primary Examiner*—Herbert F. Ross

[57] ABSTRACT

A reinforced end sealed container is prepared from a singe blank of paperboard that is symmetrically cut and scored to provide a bottom panel, foldably attached side and end wall panels, a pair of top closure flaps and a plurality of corner connecting panels, the improvement wherein the top closure flaps are also provided with integral end seal flaps and the end walls are provided with T-tabs, which, together with a notched portion of at least one of said top closure flaps, produces a container with superior end sealing strength. The notched portion of at least one of the top closure flaps serves as a reinforcing compression column between the T-tabs to provide increased resistance to any damage the container or its contents might suffer when the container is sealed closed.

4 Claims, 5 Drawing Figures

REINFORCED END SEALED CONTAINER

BACKGROUND OF THE INVENTION

The present invention relates generally to end sealed containers, and more particularly to a reinforced end sealed container which includes integral corner posts.

End sealed containers are difficult to close without damaging the contents of the container or otherwise weakening the container structure. The use of machines for closing such containers is not advisable since as many as 60% to 70% of the end sealed containers closed by machinery ultimately fail. New machinery for closing such containers has been designed but with little or no improvement in performance. However, end sealed containers are desirable since they generally use less material than containers that are closed by other methods, and, such containers if properly designed, can be closed and sealed rapidly and safely. Accordingly, the invention disclosed herein is designed to make the closing of end sealed containers practical and reliable.

End sealed containers are well known in the prior art as illustrated by the various constructions shown in the following prior art patents. U.S. Pat. No. 3,197,110 discloses an end seal carton wherein the closure flaps 27 are either adhered or stapled in the closed position. Similarly, U.S. Pat. No. 3,586,233 discloses a construction wherein end seal flaps 10, 14, 18 and 22 are used to close both the top and bottom of the container. Meanwhile, U.S. Pat. No. 3,825,170 discloses a modified construction wherein end seal flaps 18,19 and 31,32 are used to close the ends of the container. These references are exemplary of the various constructions disclosed in the prior art, however in no instance does the prior art teach a reinforced construction substantially as disclosed herein.

SUMMARY OF INVENTION

It is an object of the present invention to provide an end seal container that is stronger and more reliable than those presently in use.

It is another object of the present invention to provide an end seal container that can be readily filled and sealed on automatic machinery.

Yet another object of this invention is to provide an end seal container with reinforced corners to provide enhanced stacking strength and side-to-side crush resistance.

Still another object of the present invention is to provide reinforcing tabs on the blank which forms the end seal container whereby the end seals can be effected without crushing the container.

The above and other objects are carried out with the present invention by providing the blank structure with strategically located reinforcing tabs that cooperate with an area of at least one of the top closure flaps to prevent the end walls from collapsing inwardly when the end flaps are folded and sealed closed. Moreover, the manner of construction of the container is such that each corner is provided with an integral corner post which adds additional structural strength to the container.

The container is prepared from a corrugated paperboard blank with integral side, top, bottom and end walls. The top may be closed with full overlap or partially overlapping flaps and both the side and end walls may be reinforced with extra thicknesses of paperboard if desired. The container is formed from a substantially rectangular blank of paperboard which includes a centrally located bottom panel with foldably attached side and end walls. The blank also includes a pair of top closure flaps foldably attached to the respective side walls and a set of corner post/reinforcing panels and an end wall reinforcing panel foldably attached to each edge of the end walls. The top closure flaps may be sized to yield either a partial or full overlap construction and they are each provided with paired glue flaps foldably attached to each side thereof. Finally, to provide the necessary reinforcement to prevent the container from collapsing when it is closed, the blank includes a pair of tab extensions in the form of T-tabs on each end wall, and where the size of the container permits, additional T-tabs on each end wall reinforcing flap. The T-tabs fit within notched portions of at least one top closure flap to provide support for the end walls when the glue flaps are sealed. The portion of the top closure flap between the notches serves as a reinforcing compression column between the T-tabs to provide increased resistance to any damage the container or its contents might suffer when the container is sealed closed.

In the assembled condition, the container side and end walls are folded upwardly about their foldable connection to the bottom panel. The corner post/reinforcing panels are folded adjacent one another and secured to the side walls, and the end wall reinforcing panels are secured to the end walls. In this manner, the container is fully assembled and ready to be filled. After filling, the top closure flaps are alternately folded in overlapping relation and the container is ready for the end sealing step. The end sealing step is carried out without damaging the container because of the presence of the T-tabs on the end walls, and if applied, the coincident T-tabs on the end wall reinforcing flaps. For this purpose, the closure flaps are each notched and when folded down into a closed condition, the notches in the first folded flap fit snugly behind the aligned T-tabs on each end wall. In this position, the area of the top closure flap between the notched portions serves as a reinforcing compression column between the T-tabs to support the end walls when the end seal flaps are folded downwardly and adhered to the end walls. This construction provides more than adequate support for the end walls and prevents them from being crushed during the mechanical folding and gluing step. Moreover, because of the presence of the T-tabs and the reinforcing action of the first folded top closure flap, the contents of the container is also protected from damage.

DETAILED DESCRIPTION

Figure 1:
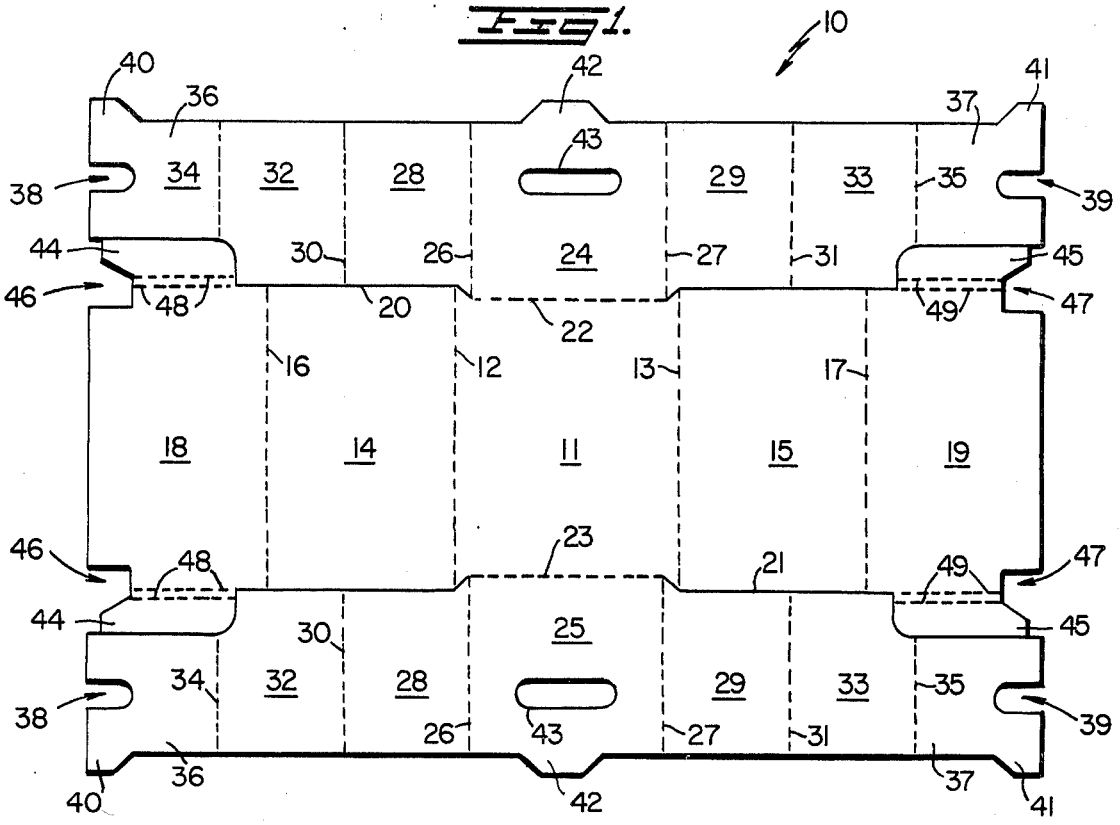
FIG. 1 is a plan view of a typical blank construction for forming the container of the present invention.

FIG. 1 illustrates the preferred blank for use in forming the container of the present invention. The blank 10 contains a substantially rectangular bottom panel 11, two side walls 14,15 foldably attached to opposite sides of the bottom panel along fold lines 12,13 and a pair of end walls 24,25 foldably attached to the remaining opposite sides of the bottom panel along fold lines 22,23. The side walls 14,15 are also foldably attached to a pair of top closure flaps 18,19 along a pair of score lines 16,17. The top closure flaps 18,19 are designed to have a width equal to slightly more than one-half the width of the bottom panel 11 so that they may partially overlap one another when the container is closed. If desired, the flaps 18,19 may be equal to the width of the bottom panel 11 where a full overlap is required. Meanwhile, each of the end walls 24,25 has foldably attached thereto, a pair of reinforcing/corner post panels 28,32 and 29,33 along score lines 26,27. The reinforcing/corner post panels 28,32 and 29,33 are of equal size and are foldably connected together along score lines 30,31 respectively. At the free ends thereof, along score lines 34,35 each of the reinforcing/corner post panels 32,33 have foldably attached thereto a pair of end wall reinforcing flaps 36,37. These flaps include partial cut outs 38,39 which coincide with the handhole cutouts 43 applied to the end walls 24,25 in those cases where the end wall reinforcing flaps 36,37 have a width equal to at least one half the width of the end walls 24,25. The end walls 24,25 also include T-tabs 42 arranged substantially centrally thereof and which extend slightly beyond the nominal edge of the end walls. In addition, where the end wall reinforcing flaps 36,37 are of a size mentioned above, they also include T-tabs 40,41 which coincide with the T-tabs 42 in the assembled condition of the container. Meanwhile, the top closure flaps 18,19 each include end seal flaps 44,45 that are foldably attached thereto along a plurality of closely spaced score lines 48,49, and which are cut from the adjacent end wall reinforcing flaps 36,37. The end seal flaps are preferably spaced slightly from the end of each top closure flap by notches 46,47 in order to accomodate the T-tabs on the end walls 24,25 and the end wall reinforcing flaps.

Figure 2:
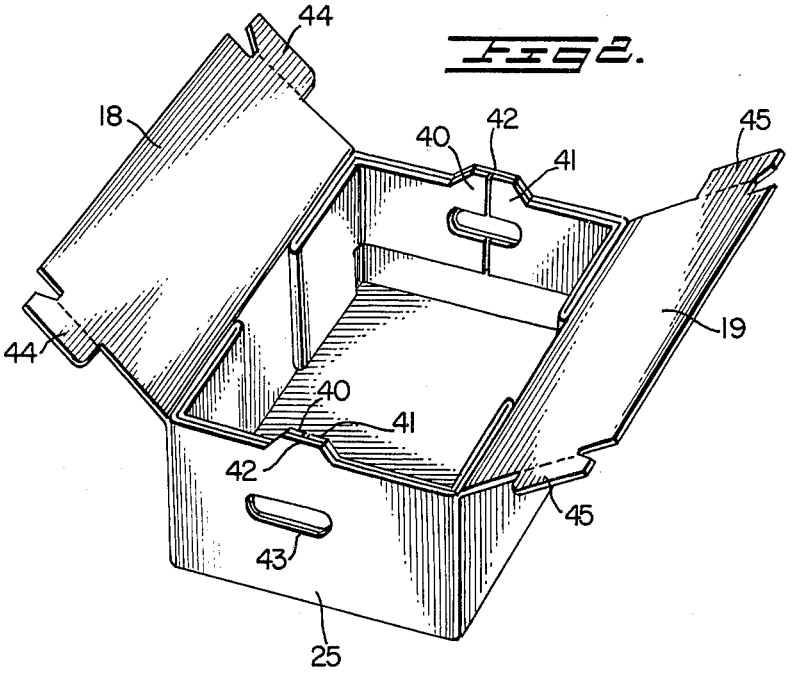
FIG. 2 is a perspective view of the container assembled from the blank of FIG. 1.
Figure 3:
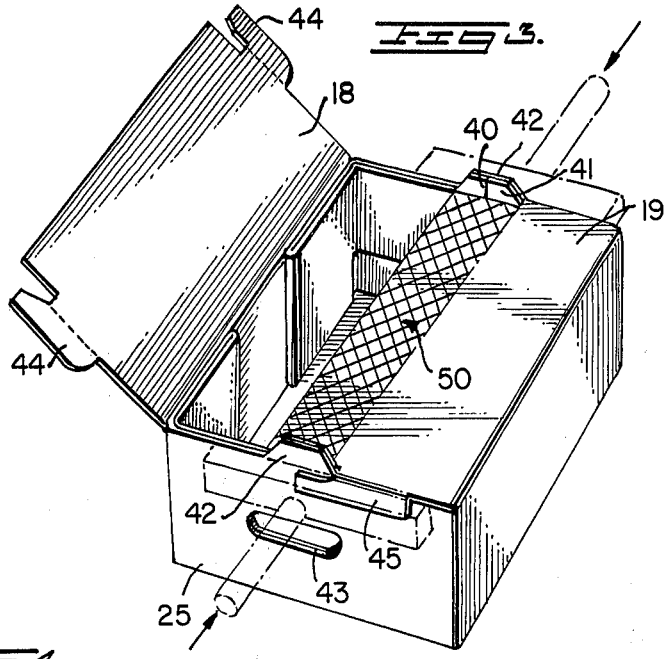
FIG. 3 is a perspective view showing the end sealing function.

In the assembled condition of the container as shown in FIG. 2, the reinforcing/corner posts 28,32 and 29,33 are folded into face-to-face contact and are adhered together and to the side walls 14 and 15. Similarly, the end wall reinforcing flaps 36,37 are adhered to the end walls 24,25. These steps produce a container that is ready to be filled and sealed. For this purpose, a standard or conventional end sealing operation is used wherein adhesive is applied to the end seal flaps 44,45 and they are pressed against the sides of the end walls 24,25. In most instances this operation tends to damage the container and sometimes crush the contents of the container. However, as shown in FIG. 3, the portion of the top closure flap 19 shown in shaded lines 50 provides a reinforcing column between the T-tabs 42,40,41 on each end wall that prevents any damage to the container or its contents during the sealing operation. Thus, when the mechanical end sealing elements apply pressure to the end seal flaps 44,45 to seal the container closed, the compression column 50 resists any inward movement by the end walls 24,25.

Figure 4:
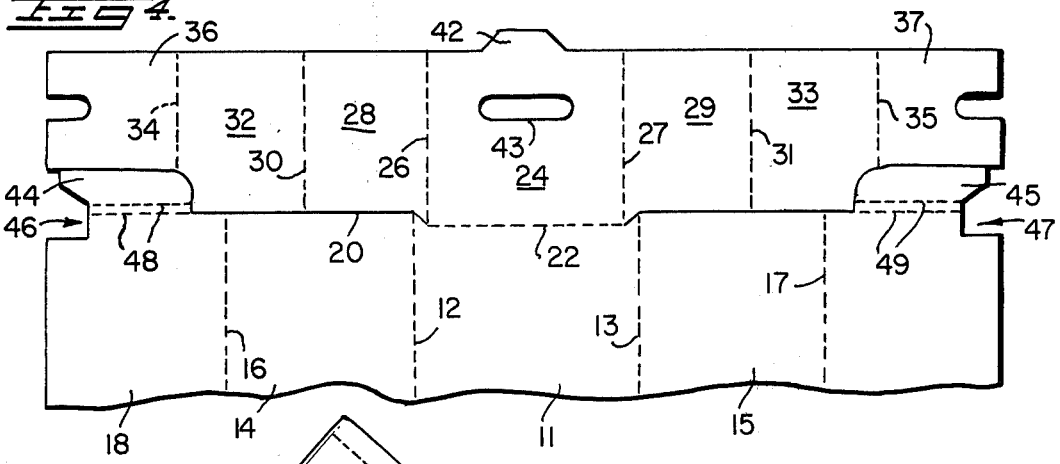
FIG. 4 shows a portion of a modified blank construction for the present invention; and, FIG. 5 shows the present invention applied to a container having full overlapping top closure flaps with an easy opening feature.

FIG. 4 illustrates a modified blank for constructing the container of the present invention. In this embodiment, the T-tabs are omitted from the end wall reinforcing flaps 36,37 where the geometry of the container does not permit the flaps 36,37 to extend across the full width of the end walls 24,25. However, the omission of the T-tabs 40,41 does not unduly affect the performance of the container during the sealing operation.

Figure 5:
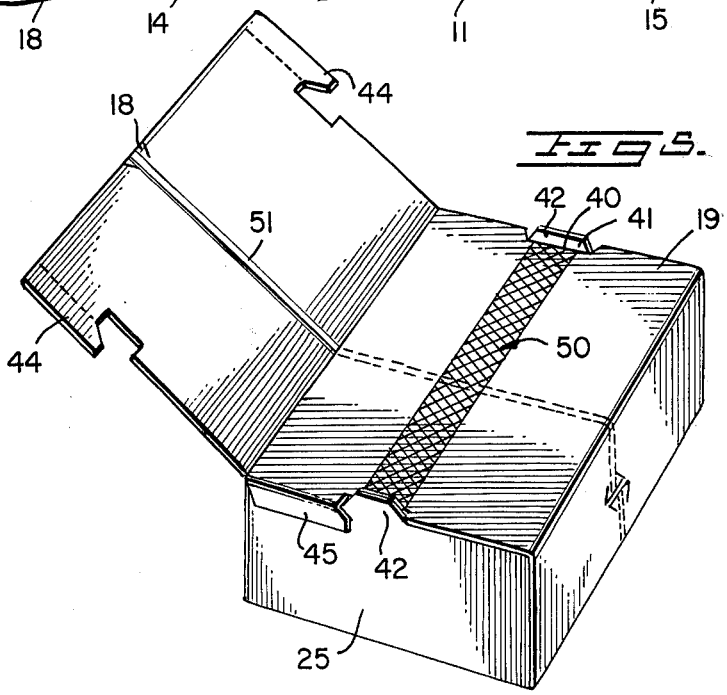

In FIG. 5, the container is shown as having full overlap top closure flaps and a ripped opening device 51 applied to the side, bottom and top walls. The full overlap flaps are used in those instances where the geometry of the container permits such an arrangement and where superior overall strength is desired.

Accordingly, it may be seen that the end seal container of the present invention is prepared from a single blank of paperboard wherein there is essentially no waste. The blank is generally rectangular in configuration and is cut and scored with suitable dimensions to accomodate the desired product. In addition, the blank is provided with unique T-tabs on the end walls of the container which act in cooperation with a portion of one of the top closure flaps to provide a compression column which resists any distortion of the end walls during the sealing step.

To those skilled in the art to which the invention relates, many changes in construction and different embodiments and applications of the invention will suggest themselves without departing from the spirit and scope of the invention as defined in the appended claims.

I claim:

1. A reinforced end seal container prepared from a single blank of paperboard comprising:

(a) a substantially centrally located quadrilateral bottom panel with foldably attached side and end walls connected to the edges thereof;

(b) a pair of top closure flaps foldably attached to the outer edges of said side wall panels, said top closure flaps including integral end seal flaps foldably attached along the side edges thereof; and, (c) a plurality of corner connecting panels foldably attached respectively to the side edges of each of said end wall panels, said corner connecting panels comprising respectively a pair of reinforcing/corner post panels which are folded adjacent to one another and secured to a portion of an adjacent side wall and an end wall reinforcing flap folded adjacent and secured to a portion of an adjacent end wall, the improvement wherein each of said end wall panels and end wall reinforcing flaps also include integral tab elements located along the outer edges thereof, said tab elements being coterminous to provide reinforcement for one another and arranged to lie adjacent to and cooperate with notched areas in said top closure flaps located in the region of said end seal flaps to provide a reinforcing compression column between the end walls when the end seal flaps are secured to the end walls.

2. The end seal container of claim 1 wherein said top closure flaps partially overlap one another at their free outer edges.

3. The end seal container of claim 1 wherein said top closure flaps fully overlap one another.

4. The end seal container of claim 3 wherein the container bottom, side walls and top closure flaps are provided with a ripped opening means for gaining access to the container.

* * * * *